United States Patent [19]

Horiuchi

[11] Patent Number: 4,796,735

[45] Date of Patent: Jan. 10, 1989

[54] CARRYING CASE

[76] Inventor: Yutaka Horiuchi, 910, 100 Eighth Avenue, Kitchener, Ontario, Canada, N2C 1S3

[21] Appl. No.: 45,456

[22] Filed: May 4, 1987

Related U.S. Application Data

[63] Continuation-in-part of Ser. No. 837,071, Mar. 6, 1986, Pat. No. 4,694,940.

[51] Int. Cl.[4] ..... A45C 3/02; A45C 13/00; A45C 13/04; A45C 13/26

[52] U.S. Cl. ..... 190/109; 190/110; 190/116; 190/119; 190/122; 190/127; 190/900; 150/108

[58] Field of Search ..... 190/11, 13 E, 100, 109, 190/110–112, 119, 122, 123, 127, 116, 117, 1, 900, 901; 150/52 B, 107, 108; 383/13; 312/244; 108/44; D3/74

[56] References Cited

U.S. PATENT DOCUMENTS

| | | | |
|---|---|---|---|
| 193,340 | 7/1877 | Lothrop | 190/11 |
| D. 271,725 | 12/1983 | Sherer | D3/74 X |
| 722,317 | 3/1903 | Moody | 190/119 |
| 1,319,761 | 10/1919 | Davis | 190/13 E |
| 1,610,146 | 12/1926 | Panzer | 190/109 |
| 1,628,812 | 5/1927 | Shwayder | 190/109 |
| 2,126,206 | 8/1938 | Plotkin | 190/109 |
| 2,213,821 | 9/1940 | McCurdy | 190/111 |
| 2,438,780 | 3/1948 | Hochner | 190/119 |
| 2,769,475 | 11/1956 | Fisher | 190/900 X |
| 3,001,566 | 9/1961 | Lipsitz | 383/13 X |
| 3,112,017 | 11/1963 | Lifton | 190/109 X |
| 3,199,643 | 8/1965 | Korchmar | 190/110 X |
| 3,263,779 | 8/1966 | Bialer | 190/110 |
| 3,408,126 | 10/1968 | Mortensen | 312/244 X |
| 3,432,102 | 3/1969 | Winter | 190/122 |
| 4,336,883 | 6/1982 | Krug et al. | 190/119 X |
| 4,383,142 | 5/1983 | Kaneko | 190/127 X |
| 4,483,427 | 11/1984 | Gerch | 190/112 X |
| 4,643,281 | 2/1987 | Erickson | 190/109 X |

FOREIGN PATENT DOCUMENTS

| | | | |
|---|---|---|---|
| 818447 | 9/1937 | France | 383/13 |
| 1080660 | 12/1954 | France | 190/111 |
| 2384423 | 11/1978 | France | 190/109 |
| 145977 | 7/1920 | United Kingdom | 190/109 |
| 156365 | 1/1921 | United Kingdom | 190/109 |
| 163059 | 5/1921 | United Kingdom | 190/100 |
| 399944 | 10/1933 | United Kingdom | 150/108 |
| 404825 | 1/1934 | United Kingdom | 190/109 |
| 1555056 | 11/1979 | United Kingdom | 190/109 |

*Primary Examiner*—Stephen Marcus
*Assistant Examiner*—Sue A. Weaver
*Attorney, Agent, or Firm*—Anthony Asquith & Co

[57] ABSTRACT

The carrying case disclosed is of the attache-case variety. It includes a tray (3) located under the lid (2) of the case. The tray overlies, and closes, the compartment (14) in the body (1) of the case when the lid of case is un-zipped and raised. The tray (3) can be used as a writing tablet (7). The tray (3) includes a flap (8) that is hinge-able relative to the remainder (7) of the tray. The flap (8) can be raised to allow restricted access to the compartment (14). Alternatively, the whole tray (3) can be raised to permit wide-open access to the compartment (14). The lid (2) of the case is provided with a corresponding hinged flap (21). The tray (3) rests on top of the inner frame (5) of the body (1) of the case. The frame encircles the whole compartment, and is rigid enough that the floor of the compartment can be of flexible fabric. A shoulder strap is attached to the frame, and lies around the frame, when not in use.

11 Claims, 6 Drawing Sheets

CARRYING CASE

CROSS-REFERENCE

This application is a continuation-in-part of Patent Application Ser. No. 837071, filed Mar. 6, 1986, now U.S. Pat. No. 4,694,940 by the same inventor.

This invention relates to carrying cases, such as document-carrying cases.

BACKGROUND TO THE INVENTION

Document or business cases may be categorized into two types:- the traditional briefcase, which opens only at one edge, and permits papers etc. to be inserted only edge-wise, and the attache-case, which opens completely, like a suitcase.

The attache-case is now the more fashionable, but the attache-case does suffer from one particular drawback, which arises from the fact that the interior compartment of the case is so highly accessible when the attache-case is opened; the very accessibility of the attache-case means that it is impossible to keep the contents of the case concealed when the case is open.

Many businessmen therefore are reluctant to use an attache-case at a conference table, or while working on a train or aircraft.

The businessmen on that basis prefer the traditional brief-case which does at least keep its contents hidden. Its disadvantage is that the traditional briefcase keeps its contents always hidden.

One aim of the invention is to provide a carrying case which can keep its contents hidden while being partly open, like a briefcase, but which can provide wide-open access, like an attache-case.

GENERAL DESCRIPTION OF THE INVENTION

In the invention, the case has a lid, and has a body which defines an interior compartment. The case also includes a tray, which is situated inside the lid, the tray being openable relative to the body in such a manner that when the tray is opened, the compartment is wide open and highly accessible, in the manner of an attache-case.

In the invention, the tray includes a flap.The flap is independently openable relative to the body, so that the flap portion of the tray may be opened when the rest of the tray is closed. The flap occupies only a minor portion of the whole tray and is dimensioned to give only a restricted access into the compartment when the flap is open, in the manner of the traditional briefcase.

Thus, the carrying case of the invention, by virtue of the flap in the tray, may be set like an attache case, with the compartment wide open, or it may be set like a traditional briefcase, with the contents of the case restrictedly accessible and hidden from view.

The fact that the two kinds of access are provided in a tray which is itself covered by, and can be closed by, an outer lid has additional benefits. The fact that the lid is present means that the main portion of the tray can be used to hold such an item as a pad of paper, and, more importantly, the flap portion can include pockets which can be used to contain such articles as a calculator, business cards, small stationery items, etc.

The flap of the tray in fact has its own special, and advantageous, kind of access. The upper face of the flap is covered whenever the lid is closed, and yet the upper face is exposed completely, virtually as soon as the lid starts opening. This fact makes the upper face of the flap eminently suitable for containing the items as mentioned.

It is recognized in the invention that such a flap in a tray in a case, since the upper face of the flap is so easily exposed, provides very ready access to the small items, when the businessman opens the lid by a small amount. The fact that the lid can be closed over the flap when appropriate of course is important also. In the invention, this highly convenient means of access to the small items in the upper face of the flap is achieved without compromising the ability of the flap to provide the variety of types of access to the interior; ie. to provide, as mentioned, both the partly-concealed access, and the wide-open access, to the interior.

Thus, in the case of the invention, the interior compartment can have three states of accessibility: (a) the interior compartment can be fully closed; (b) the interior compartment can be partially open, in that the contents are accessible and yet at the same time concealed, or (c) the interior compartment can be wide open; in the case of the invention also the tray can be either closed or wide open, which means that the tray itself is very suitable as a writing tablet; in the case of the invention also, the upper face of the flap of the tray is completely accessible as soon as the lid is opened by only a small amount, which makes the upper face of the flap an ideal place for containing small items. It is recognized in the invention that, if the upper face of the flap were not covered by the lid, the upper face would be quite unsuitable as a place for the containers of the small items.

These different kinds of access are all useful in themselves, and the different kinds of access complement each other, without wasteful duplication. It is recognized that this tremendous variety of kinds of access, unparalled in cases known hitherto, is due mainly to the provision of the flap on the inner tray, and to the positioning of the flap in relation to the lid of the case so that the upper face of the flap is exposed as soon as the lid starts to open.

DETAILED DESCRIPTION OF PREFERRED EMBODIMENTS OF THE INVENTION

Examples of cases which embody the invention are shown in the drawings.

Figure 6:
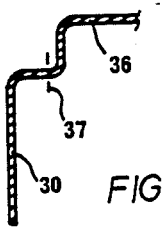
FIG. 6 is a cross-section of the component of FIG. 5.
Figure 7:
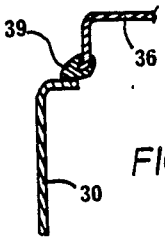
Figures 8, 8A:
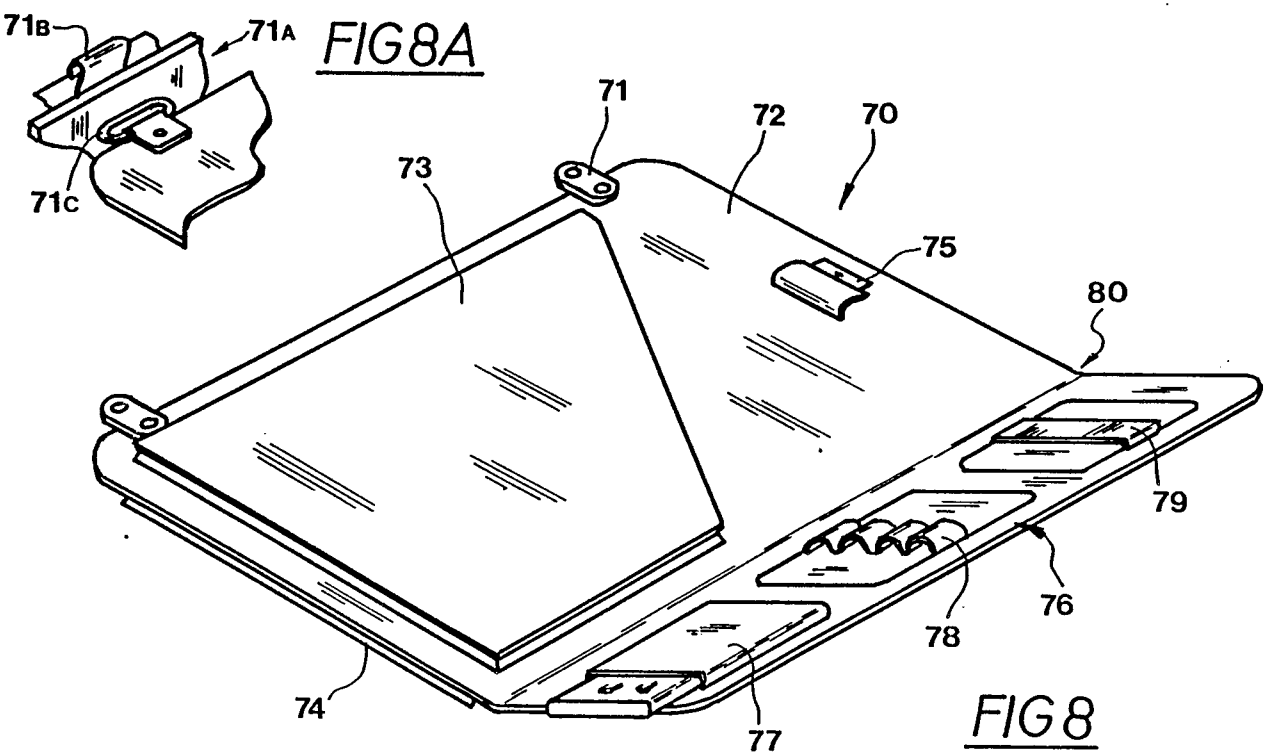

FIG. 7 corresponds to FIG. 6, and shows a different stage in the assembly of the case;

FIG. 8 is a pictorial view of another case.

Figure 9D:
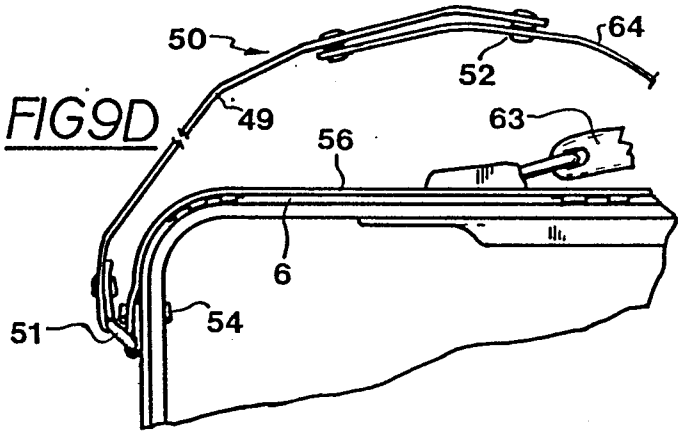
Figure 9B:
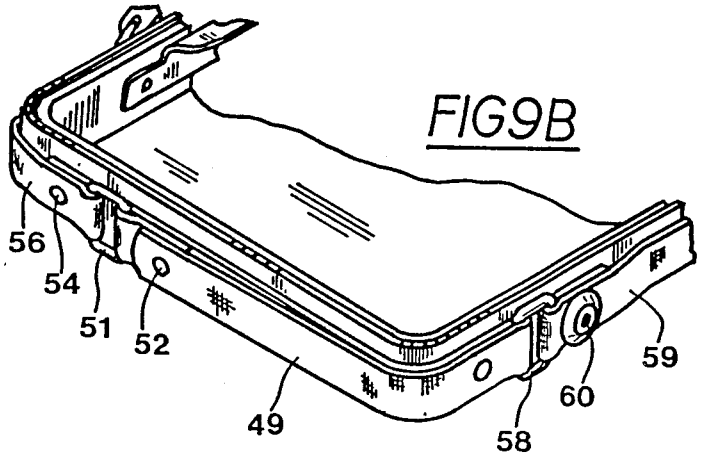
Figure 9C:
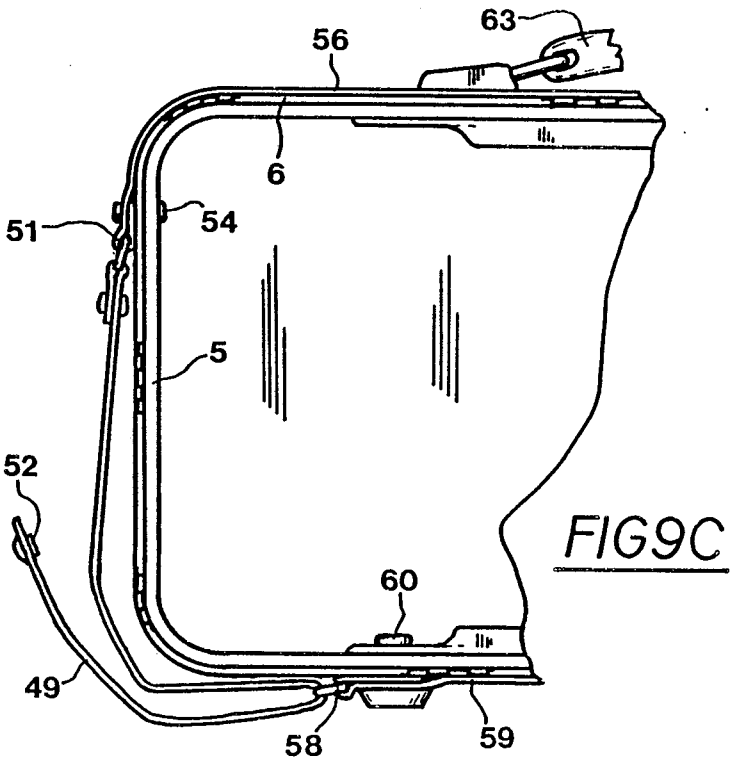
Figure 9A:
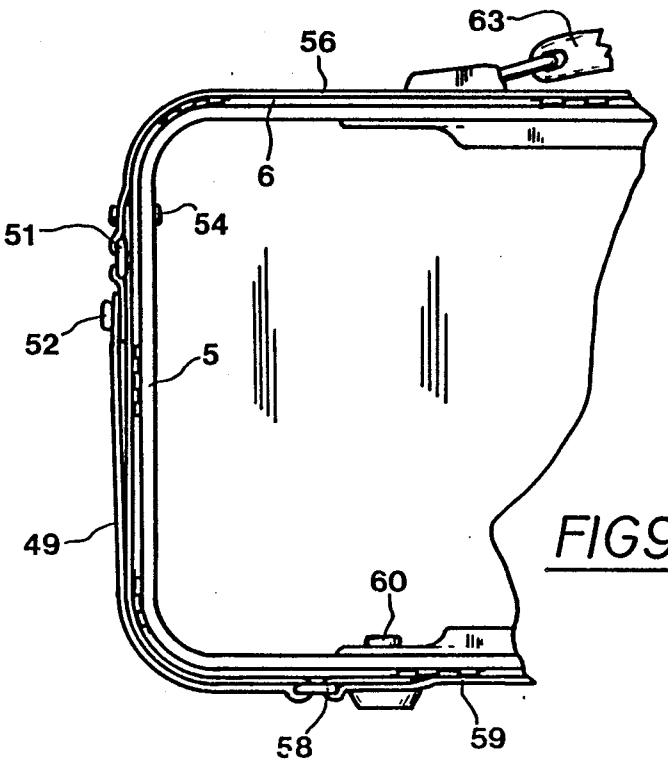

FIG. 8A is a view corresponding to FIG. 8 of yet another case;

FIG. 9A is a cross-section of, and FIG. 9B a pictorial view of, part of a case which includes a shoulder strap;

FIGS. 9C and 9D correspond to FIG. 9A, and show the shoulder strap in various stages.

Figure 1A:
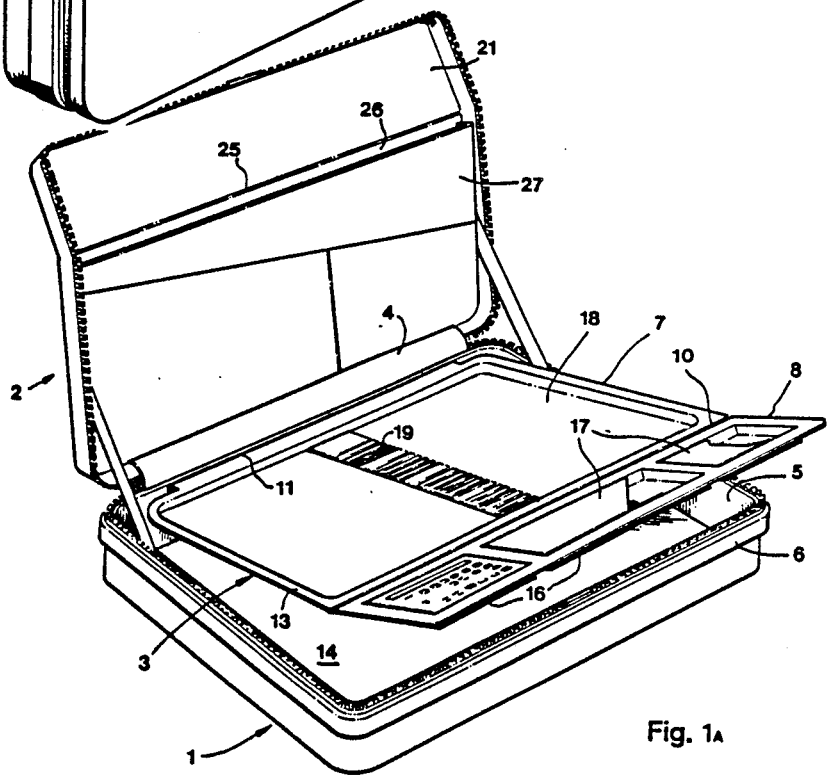
FIG. 1A is a pictorial view of a case, which shows a tray of the case in the almost fully open position.
Figure 1B:
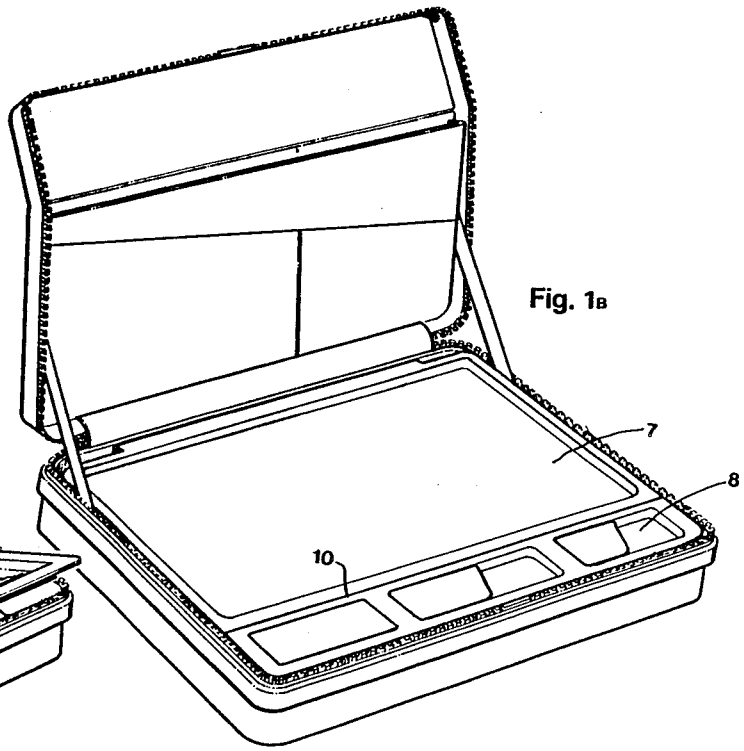
FIG. 1B is a corresponding view to FIG. 1A, but shows the tray in the fully closed position.
Figure 1C:
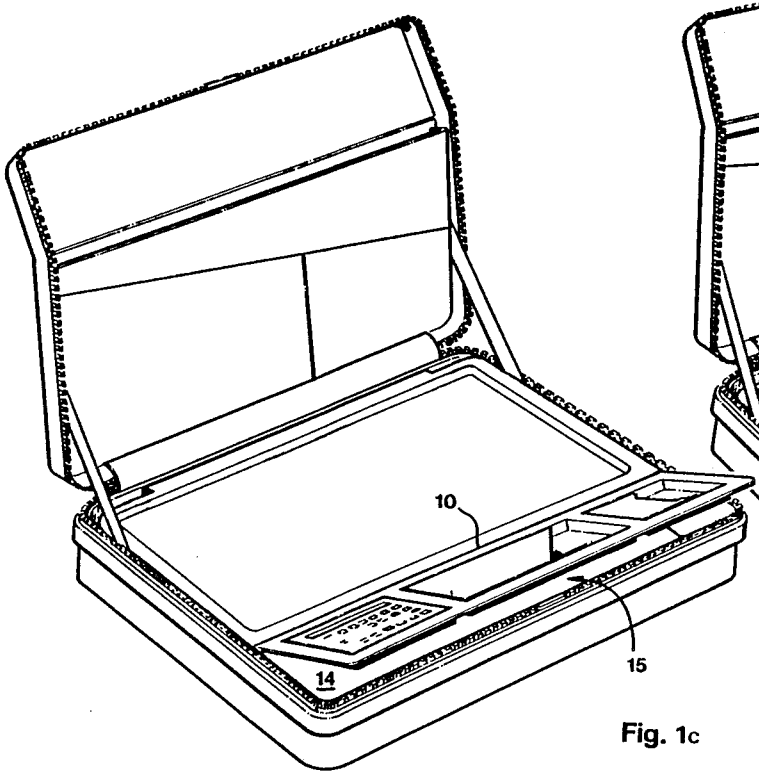
FIG. 1C is a corresponding view to FIG. 1A, but shows the tray in a partly open position.

The case shown in FIG. 1 comprises a body 1, a lid 2, and a tray 3. The lid 2 is hinged to the body 1 by means of a hinge-band 4.

The body 1 and lid 2 are of conventional construction. As shown, the body 1 includes an inner stiffening frame 5 and an outer stiffening frame 6, but the particular manner of constructing the body and lid is not essential to the invention in its broadest sense. The body might, for example, be made as a one-piece moulding in plastic material. However, the inner frame 5, when an inner frame is present, can be arranged to provide an abutment which is useful in the invention as will be explained presently. The frame arrangement can be useful too in providing an anchorage for a shoulder strap, as shown in FIG. 8, or for a conventional carrying handle The case includes the tray 3. The tray 3 is a unitary or one-piece component which is vacuum-formed out of sheet plastic material. The tray 3 includes a main-portion or tablet 7, a flap-portion 8, and a lug-portion 9. Each of these three portions 7, 8, 9 is rigid in itself, and the tray 3 is provided with two hinges 10, 11 so that the portions 7, 8, 9 can articulate relatively, as shown. The hinges 10, 11 lie parallel to the hinge that is defined and provided by the hinge-band 4.

The hinges 10, 11 are of the "living hinge" kind, in that the hinges 10, 11 are formed integrally into the material, by making the material locally thinner along a crease-line. The thinning can be performed by melting the material locally, or by cutting a groove in the material.

It may be noted that a living hinge is not as a general rule regarded as being reliable over a long service life, because there is a tendency in a living-hinge for a tear to start at the crease. It is recognised in the invention that a living hinge is acceptable in the case of the invention, because the arcuate movement at the hinge is required to be only a few degrees.

The tray 3 is formed all round with a lip 13, which rests on the abutment provided by the inner frame 5 (FIG. 3), as referred to above.

The tray 3 may take up one of three positions. First (FIG. 1B) the tray 3 may be closed. Here, the tablet 7 and the flap 8 are both resting with the lip 13 on the inner-frame 5. The compartment 14, defined by the body 1, is now fully closed and inaccessible.

In the second position (FIG. 1A) the tray 3 is open. Now, the lip 13 is well clear of the inner frame 5, and the compartment 14 is fully open and accessible.

In the third position (FIG. 1C) the tray 3 is in a partly-open position. Here, the tablet 7 is closed down onto the inner frame 5, but the flap 8 has been raised, by pivoting the flap 8 about the hinge 10. The flap 8 is so dimensioned that a person's hand can be inserted into the gap 15 thus produced, to gain access to the compartment 14. This access through the gap 15 is not of course as complete as the access provided when the tray 3 is in the fully open position, but the restricted access is nevertheless quite adequate for checking the contents of the compartment 14, and for withdrawing papers occasionally. It will be noted that when the tray 3 is in the partly open position, the contents of the compartment 14 are well hidden.

The shape and size of the tray 3 as shown is such that when the tray 3 is in the closed (FIG. 1B) position the tray completely covers the compartment 14. It is recognised in the invention that sometimes it is not necessary for the tray to completely cover the compartment. The tray might, for example, be somewhat narrower than the compartment, and yet such a tray, when closed, could still act to retain and to mask the contents of the compartment.

The upper face of the flap portion 8 of the illustrated tray 3 has been provided with wells 16 for the purpose of receiving a calculator, pens and pencils, business cards, or other appropriate articles. The wells 16, as shown, have been provided with snap-in or glued-in covers 17 to retain the items in the wells.

When the lid 2 is closed, of course the upper face of the flap portion 8 is concealed. As soon as a person has opened the lid 2 only slightly, the upper face of the flap portion 8 is exposed, and the person has access to the items stored therein.

The tablet 7 has also been formed with a well 18, which is dimensioned to receive a standard-sized pad of paper. An elastic band 19 serves to locate the pad in the well 18. The wells 16, 18 serve to stiffen the tray, which ensures that the tray cannot bend except at the hinges.

Figure 2:
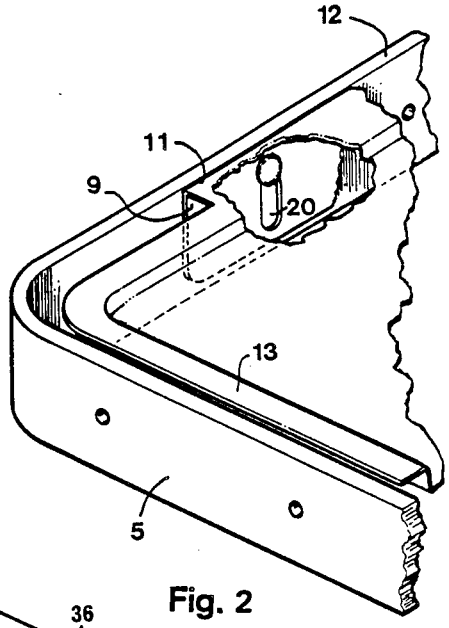
FIG. 2 is a cut-away close-up view of a corner of the case.

The lug 9 is attached to the backwall 12 of the body 1. As shown in FIG. 2 the lug 9 has slots 20 at its attachment point with the back wall 12. The slots 20 permit the tray 3 to rise and remain level if the compartment 14 should be over-filled.

The lid 2 of the illustrated case is also provided with a flap 21. The lid-flap 21 overlies the tray-flap 8. The lid 2 is closed onto the body 1 by means of two slide fasteners 22, 23. These are arranged symmetrically, and it will be noted therefore that the slide fasteners may be pulled back so that only the lid-flap 21 is opened, while the remainder or main-portion 24 of the lid 2 remains closed.

The lid-flap 21 of the lid 2 is hinged with respect to the main-portion 24, of the lid 2; the result is that a person may easily take out a business card, for example, from the wells 16 of his case without opening the whole lid. However, as pointed out above, the upper face of the tray flap 8 is well-accessible upon partially openening the lid, even if the lid does not have the extra benefit of a lid-flap.

The hinge 25 of the lid-flap 21 may be formed also as a living hinge, or, when the lid is of flexible fabric, as illustrated, the hinge 25 may simply comprise the limit of a stiffening board 26 attached to the lid 2. A pocket 27 may be incorporated also into the lid 2.

Figure 4:
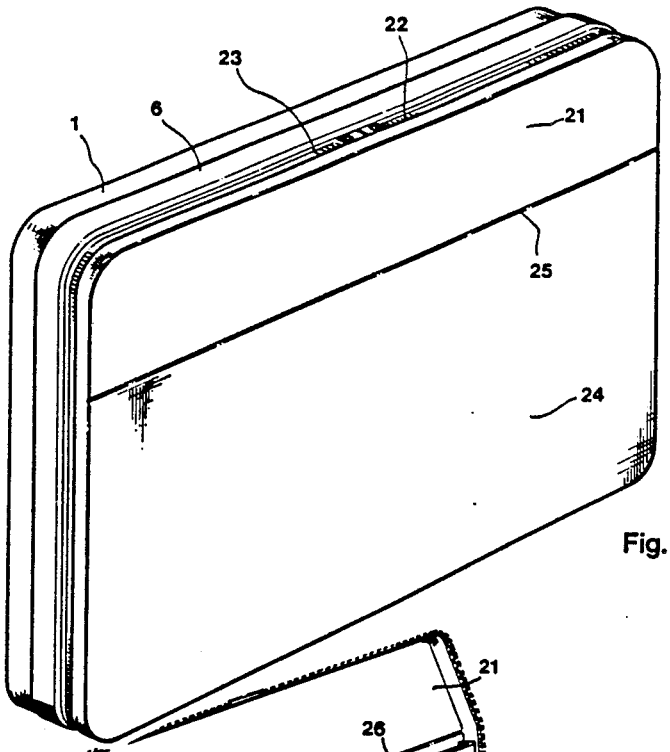
FIG. 4 is a pictorial view of the exterior of the case.

The hinge 25 permits the lid 2 to incorporate an attractive design feature; instead of the lid 2 being a mere flat slab, the hinge 25 divides the lid into two rectangular areas, each of pleasing and harmonious proportions, as shown in FIG. 4.

Figure 5:
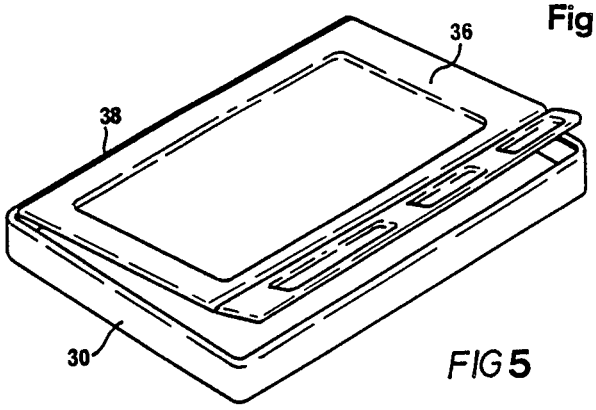
FIG. 5 is a pictorial view of a component of the case, made in an alternative manner.

FIG. 5 illustrates another manner of arranging the tray. Here, the inner frame 30 and the tray 36 are formed together from a single piece of sheet plastic material, by vacuum forming. The tray 36 is then sheared at 37 (FIG. 6) from the frame 30, except that the back edge of the tray 36 is left attached to the back wall of the frame 30 by means of a living hinge 38. A trim strip 39 (FIG. 7) can be added around the edge of the tray 36, so that the tray 36 may rest on top of the frame 30 when the tray is in the closed position.

The inner frame and tray can be very inexpensive when made in the FIG. 5 manner. Also, the resulting construction is light in weight, yet it is adequately rigid because the bent-over edges of the frame 30 and tray 36 act as stiffeners.

FIG. 8 illustrates a different manner of constructing the tray of the invention. Here, the tray 70 is secured, detachably, to the back wall of the body by means of strap-hinges 71. The main portion 72 of the tray is flat, and is provided with pockets above 73 and below 74, for holding papers. A clip 75 is also provided for securing papers.

As shown in FIG. 8A, the strap hinges 71 may be replaced by alternative hinges 71A. Each hinge 71A comprises a hook 71B, which is fixed into the back wall of the body, and an eye 71C which is fixed into the tray. The eyes 71C may be detached from the hooks 71B, so that the tray may be disassembled from the body.

The flap portion 76 of the tray includes, in its upper face, a clear plastic holder 77 for a calculator, a pen-holder 78, and an elastic card-retainer 79, which are all formed in the upper surface of the flap portion 76. Such a tray 70 may be constructed out of sheets of card, one for the main portion 72 and one for the flap portion 76, the sheets being covered above and below by a suitable fabric or cloth. The hinge 80 between the two portions is formed simply by leaving a small gap between the two sheets.

In the invention, the frame of the case, comprising the inner frame and the outer frame, extends all round the walls of the interior compartment 14, and defines the well-shaped character of the compartment. The frame has all the rigidity the case needs in itself, and the floor of the compartment can be of flexible fabric material.

Figure 3:
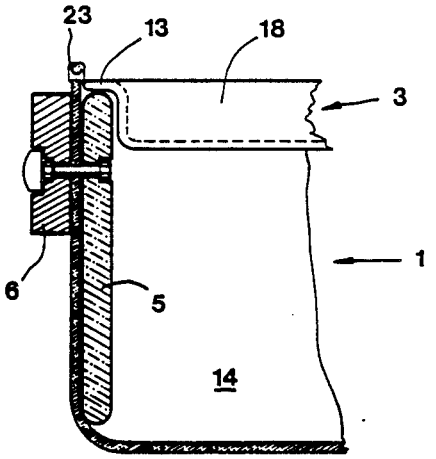
FIG. 3 is a cross-section at a side-wall of the case.

The floor of the case is of flexible material, which, as shown in FIG. 3, extends between, and is sandwiched between, the inner frame and the outer frame.

The inherent rigidity, coupled with the inexpensive construction, of this kind of frame can be turned to further advantage, in that the frame can easily be used to provide a sturdy base for the attachment of a shoulder strap. FIGS. 9A-D show a case which includes a shoulder strap 50, which is suitable for supporting the weight of the case.

It is important that a shoulder strap, when not in use, be stowed on the outside of the case: a method of stowing the shoulder strap that requires the case to be unpacked has little chance of success. It is also important that, when stowed on the outside, the shoulder strap should be neat and unobtrusive. It is also important that the weight of the case be transmitted to the strap through attachment points that are strong and rigid, yet are also neat and unobtrusive.

All these aspects can be accommodated in the shoulder strap arrangement shown in FIGS. 9A-D. FIGS. 9A and 9B show the strap in the stowed-away condition, from which it may be noted that the strap is so unobtrusive that it can barely be perceived that the case actually is provided with the shoulder strap.

The shoulder strap 50 is in two parts, one on each side wall of the case. One end of the part 49 of the strap 50 is attached to a ring 51 by means of a press-fastener 52. The ring 51 is secured to the frame 53 by means of a stud 54. An upper supplementary strap 56 is important in maintaining a visual continuity around the case. The back wall 57 of the case also is fitted with a ring 58, which is secured by means of a lower supplementary strap 59 and a further stud 60.

The case is also provided with a handle 63.

FIG. 9C shows the shoulder strap 50 partly unfolded, and being made ready for use. FIG. 9D shows the press-fastener 52 secured to the corresponding fastener of the other part 64 of the strap 50 on the other side of the case. It may be noted that the forces from the shoulder strap are fed into the frame directly through the stud 54, and the coressponding stud of the other strap 64, and that the frame is inherently so shaped as to be easily capable of supporting such forces, when so applied.

Although the carrying case that has been described and illustrated is a businessman's portfolio the invention is applicable to other kinds of carrying case. The basic feature of the invention is the tray with its movable flap, which permits a choice of either wide-open access or restricted access to the compartment below. This feature is useful not only in briefcases, but also in sports bags, and in luggage generally.

I claim:

1. A carrying case, which comprises a body (1), a tray (3), and a lid (2), characterized:

in that the lid is separate from the tray (3);

in that the lid is pivotably attached to a back wall (12) of the body (1);

in that the tray is pivotably attached to the said back wall;

in that the body includes side-walls and a front-wall which, together with the back-wall, define a well-shaped compartment (14) in the body;

in that the tray (3) includes a main-portion (7) and a flap-portion (8), the portions being connected by a flap-hinge (10), which permits relative pivoting movement therebetween;

in that the axis of the flap-hinge is spaced from the said back wall of the body;

in that the axis (11) about which the tray is pivotable, and the axis about which the lid is pivotable, and the axis of the flap hinge, are all three parallel;

in that the flap-portion (8) is smaller than the main-portion (7);

in that the main-portion (7) is rigid;

and in that the tray (3) can be set selectably to all these positions relative to the body:

(a) a closed position, in which the said two portions (7,8) of the tray (3) lie over respective parts of the well-shaped compartment (14), the tray (3) being so shaped and dimensioned as to substantially close at least a major part of the well-shaped compartment (14) when set in the closed position;

(b) a wide-open position, in which both portions (7, 8) are displaced away from the well-shaped compartment (14), leaving the well-shaped compartment wide open;

(c) and a partially-open position where the main-portion (7) lies over, and substantially closes, a part of the well-shaped compartment (14), and where, simultaneously, the flap-portion (8) lies open enough relative to the body (1) to permit access into the well-shaped compartment.

2. Case of claim 1, where the flap-portion (8) is rigid, and is provided, in the upper face of the flap-portion—the upper face of the flap-portion being the face that faces away from the well-shaped compartment—with one or more flap-wells (16), so constructed and arranged as to be suitable for receiving and containing small items of stationery, business cards, and the like.

3. Case of claim 1, where the flap portion (8) and the main-portion (7) exist together as a single unitary piece of material (3);

and where the flap-hinge (10) is a living-hinge in that the flap-hinge comprises a crease in the said piece of material, formed between the flap-portion (8) and the main-portion (7).

4. Case of claim 1, where the tray (3) includes also a lug-portion (9);

where the lug-portion (9) is fixed to the back wall (12);

where the lug-portion and the main-portion (7) exist together as a single unitary piece of material;

where the tray is pivotable with respect to the back-wall about a tray-hinge;

and where the tray-hinge (11) is a living hinge formed between the lug-portion (9) and the main-portion (7).

5. Case of claim 4, where the case includes an adjustment means, for adjusting the height of the tray (3) relative to the the body (1).

6. Case of claim 1, where the body (1) includes an inner frame (5) which is located inside the compartment (14);

where the inner frame is included in the walls of the well-shaped compartment;

where the tray (3) includes a lip (13);

and where the tray is of a dimension such that the lip (13) rests on the inner frame (5) when the tray (3) is set to the closed position.

7. Case of claim 1, where the body (1) includes a frame (5) which extends around all four walls of the well-shaped compartment of the body; and where the said frame is so constructed and arranged as to provide structural rigidity to the well-shaped compartment.

8. Case of claim 7, where the frame includes an inner frame (5) and an outer frame (6);

where the body includes a floor to the well-shaped compartment (14);

where the said floor is made of flexible material;

and where the flexible material extends between, and is sandwiched between, the inner frame and the outer frame.

9. Case of claim 7, where the case is provided with a shoulder strap;

where the shoulder strap includes means for connecting it to the frame such that the shoulder strap supports the weight of the case, the weight of the case being transmitted from the shoulder strap directly to the frame.

10. Case of claim 9, where the connecting means permits the shoulder strap to be retracted when not in use to a position in which folded lengths of the shoulder strap are laid around the frame, on the outside of the case.

11. Case of claim 8, where the inner frame and the tray exist together as a single unitary piece of material.

* * * * *